US005746522A

United States Patent [19]

Moreland

[11] Patent Number: 5,746,522

[45] Date of Patent: May 5, 1998

[54] LIQUID TANK RE-INKER USING BALL TRANSFER MECHANISM

[75] Inventor: Richard B. Moreland, Centerville, Ohio

[73] Assignee: NCR Corporation, Dayton, Ohio

[21] Appl. No.: 763,911

[22] Filed: Dec. 11, 1996

[51] Int. Cl.[6] ..... B41J 31/14; B41J 32/02

[52] U.S. Cl. ..... 400/197; 400/202; 400/202.3

[58] Field of Search ..... 400/197, 202, 400/202.1, 202.3, 202.4

[56] References Cited

U.S. PATENT DOCUMENTS

| | | | |
|---|---|---|---|
| 2,745,533 | 5/1956 | Keleher | 197/171 |
| 3,232,406 | 2/1966 | Schwartz | 400/202.2 |
| 3,951,253 | 4/1976 | Tibay et al. | 197/171 |
| 4,071,133 | 1/1978 | Scherrer et al. | 197/168 |
| 4,223,603 | 9/1980 | Faddis et al. | 101/180 |
| 4,267,772 | 5/1981 | Maitland | 101/103 |
| 4,552,063 | 11/1985 | Bronson | 101/35 |
| 4,653,947 | 3/1987 | Echols | 400/202.4 |
| 4,824,514 | 4/1989 | Schneider et al. | 101/329 |
| 5,207,158 | 5/1993 | Fadner et al. | 101/348 |
| 5,401,108 | 3/1995 | Debreczenyi | 400/202.4 |
| 5,567,065 | 10/1996 | Cai et al. | 400/197 |

*Primary Examiner*—Edgar S. Burr
*Assistant Examiner*—Amanda B. Sandusky
*Attorney, Agent, or Firm*—Charlene Stukenborg

[57] ABSTRACT

An apparatus for reinking a printing ribbon which includes a tank for ink fitted with a ball which, when rotated, transfers a quantity of ink to a sheathed wheel which in turn transfers this ink to a gear through which the ribbon travels and absorbs the ink is provided. An inked printing ribbon cassette including the reinking apparatus is also provided.

8 Claims, 2 Drawing Sheets

LIQUID TANK RE-INKER USING BALL TRANSFER MECHANISM

The present invention relates to an apparatus for reinking a printing ribbon in a cassette and the inked printing ribbon cassette containing such an apparatus.

BACKGROOUND OF THE INVENTION

Re-inking apparatuses for providing additional ink to a ribbon in a cassette generally include a reinking chamber or wheel saturated in ink and having a wick or using direct contact to apply ink to the ribbon or to a gear or wheel which drives the ribbon. However, these apparatus for re-inking either provide re-inking in less than the desired quantity or cause the ink to be applied in splotches. In devices that use foam or felt pads, the capillary pressure is dependent upon the amount of ink in the reservoir. As the ink is depleted, the capillary pressure is reduced so the transfer of ink to the ribbon is reduced. Another problem with devices that use foam is that variations in foam density and porosity cause inconsistent print quality among various cassettes. Therefore, there is a need for providing a greater amount of ink to be stored for transfer while providing higher density, consistent print quality without splotches.

SUMMARY OF THE INVENTION

In accordance with the teachings of the present invention, an apparatus for reinking a ribbon which includes a tank for ink fitted with a ball which, when rotated, transfers a quantity of ink to a sheathed wheel which in turn transfers this ink to a gear through which the ribbon travels and absorbs the ink.

It is an object of the present invention to provide an apparatus which stores a greater amount of ink for transfer to a printing ribbon to provide a longer life inked ribbon printer cassette.

It is another object of the present invention to provide an apparatus which provides a greater amount of ink while still maintaining excellent print quality without splotches.

It is yet another object of the present invention to provide an apparatus which does not have a reduction in ink transfer to the ribbon as ink is depleted from the reservoir.

Still another object of the present invention is to provide apparatuses providing repeatable higher density print quality among several cassettes.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION

Figure 1:
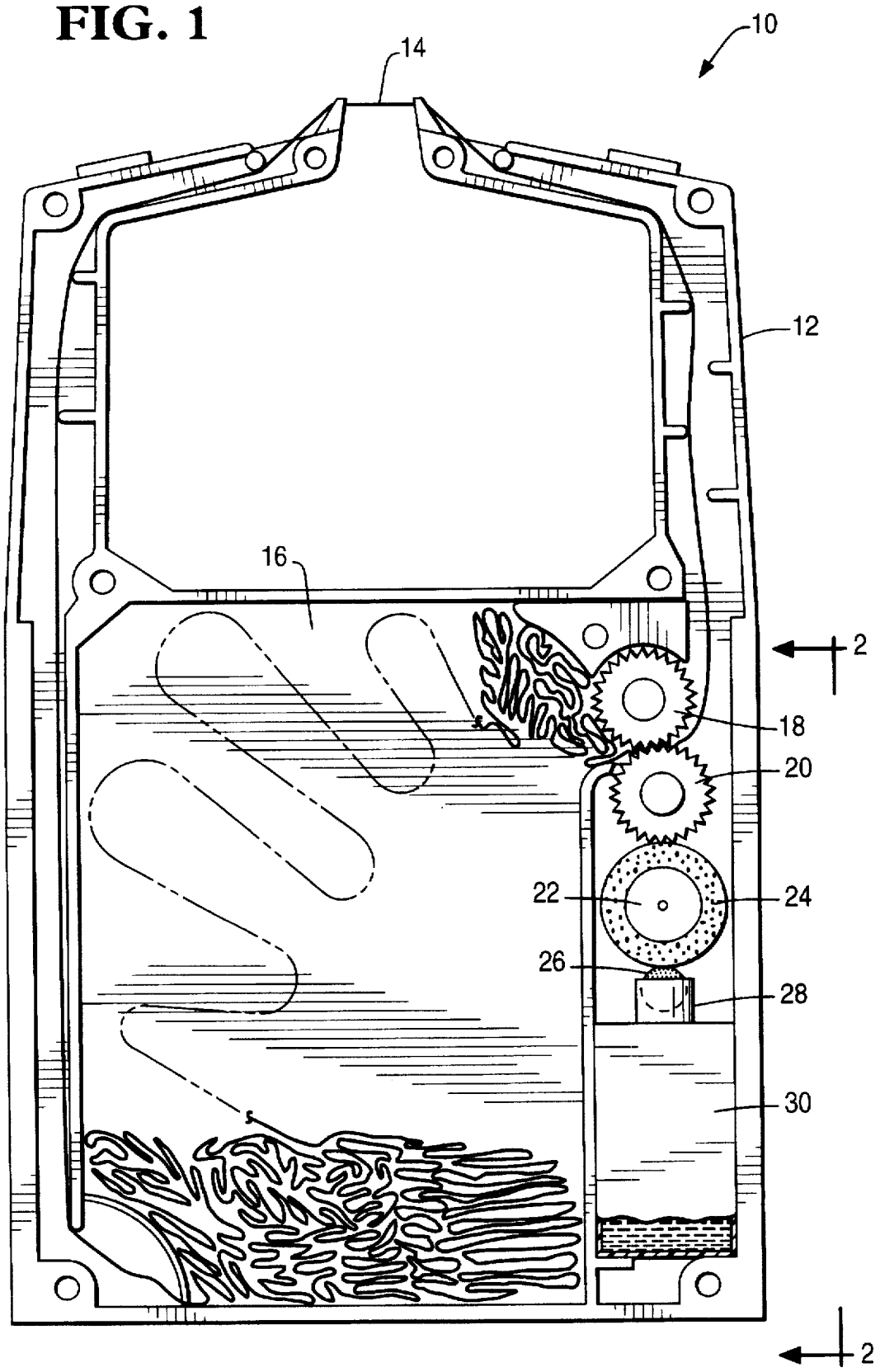
FIG. 1 shows a top view of an inked ribbon printer cassette including the liquid tank re-inker using a ball transfer mechanism according to the present invention.

Referring now to the drawings, in which like-referenced characters indicate corresponding elements throughout the several views, attention is first drawn to FIG. 1 which shows a top view of an inked ribbon printer cassette 10 having a liquid tank re-inker using a ball transfer mechanism of the present invention. The inked ribbon printer cassette 10 includes a housing 12, preferably formed of ABS plastic or like material commonly used to mold housings for ribbon cassettes. Inked ribbon printer cassette 10 also includes a ribbon 14, preferably a nylon ribbon. The housing 12 of inked ribbon printer cassette 10 also includes a ribbon storage cavity 16 for storing the ribbon 14 until just before it is guided in front of a print head for operation. The housing 12 also includes a pair of rollers; drive roller 18 and idler roller 20, for guiding and re-inking the ribbon 14 out of the ribbon storage cavity 16 before it is guided in front of the print head for operation. Drive roller 18 and idler roller 20 are preferably gears as are well-known in the art.

Figure 2:
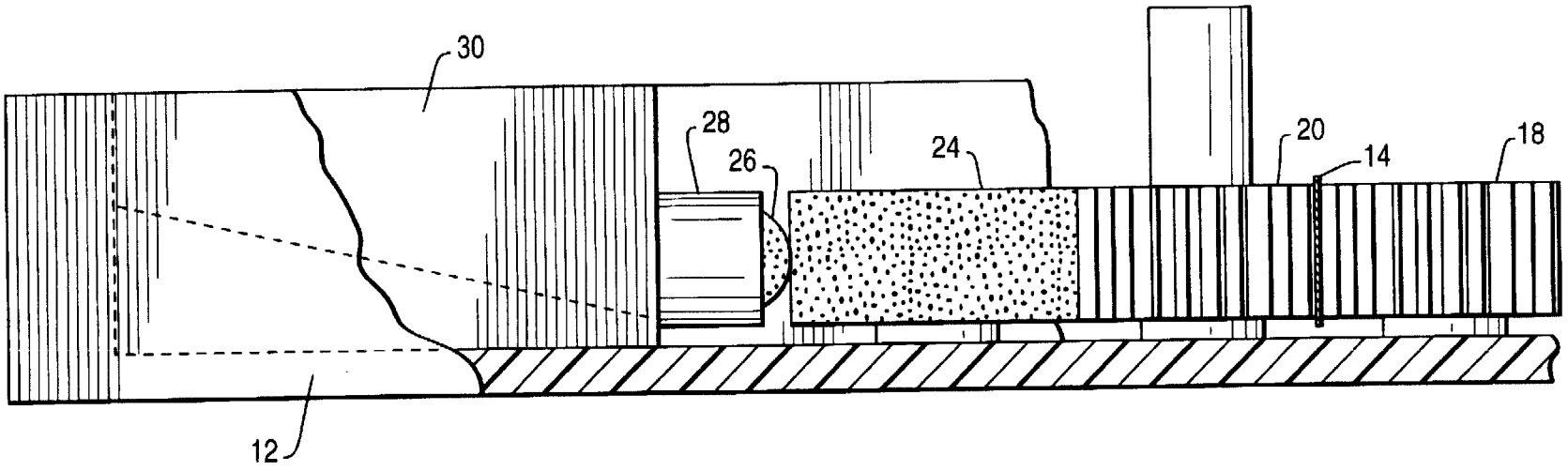
FIG. 2 shows a view along reference line 2—2 of FIG. 1 with the housing broken away to show a side view of the re-inker apparatus of the present invention.

Next the liquid tank re-inker using a ball transfer mechanism according to the present invention will be discussed. Liquid tank re-inker includes a tank 30 for storing liquid ink. The tank 30 is preferably of molded plastic. The tank 30 has a tapered neck 28 with an opening into which a porous ball 26 is rotatably disposed. Porous ball 26 is preferably of a ceramic material. Adjacent to the porous ball 26 is a wheel 22 having a slightly porous sheath 24 around the circumference. Slightly porous sheath 24 contacts idler roller 20. Slightly porous sheath 24 may be formed of neoprene or slightly porous rubber material. FIG. 2 shows a view along reference line 2—2 of FIG. 1 with the housing broken away to show a side view of the re-inker apparatus.

In operation, ink from liquid tank 30 contacts the side of the porous ball 26 which is in the neck portion 28 of the liquid tank 30. When the porous ball 26 rotates, the ink on the porous ball 26 is transferred to the sheath 24. The sheath is adjacent and touching the idler roller 20 and so the wheel 22 and sheath 24 turn as the idler roller turns. When the wheel 22 and sheath 24 turn, ink is transferred to the idler roller 20. The ink on idler roller 20 is transferred to the ribbon 14 as the drive roller 18 and idler roller 20 pull the ribbon 14 out of the ribbon storage cavity 16.

The use of the liquid ink in the tank 30 provides the maximum amount of ink that can be contained in the available space. Saturated foam or porous re-inkers are not able to provide the same amount of ink as some of the ink remains residual in the foam. The use of the porous ball to convey the ink out of the tank 30 provides a smoother contact and is unlikely to cause splotches as are possible when a wick is used to convey ink from a tank. Porous ball 26 uses the rotation of the rollers 18, 20 and wheel 22 to cause the ink inside the tank to be rotated outside the tank and eventually transferred to the ribbon. Thus if the rollers 18, 20 and wheel 22 are not rotating, as when the ribbon is not advancing, then the porous ball 26 does not convey ink outside of the tank 30. In contrast, a wick uses capillary action to convey ink and thus continues to transfer ink even if the rollers and thus the ribbon are not advancing. Additionally, as ink is depleted in a reservoir of a system using capillary pressure to provide ink to the ribbon, the capillary pressure is reduced leading to a lesser amount of ink being transferred to the ribbon. This reduction in ink transfer causes inconsistent and lower density print quality.

The use of the wheel 22 and sheath 24 provides an additional smoothing contact to insure excellent quality printing without splotches.

Advantageously, the apparatus of the present invention provides a greater amount of ink for transfer to a printing ribbon to provide a longer life inked ribbon printer cassette.

Yet another advantage of the present invention is providing an apparatus which provides a greater amount of ink while still maintaining excellent print quality without splotches.

Still another advantage of the present invention is that since foam or felt pads are not used, variations between cassettes caused by variations in foam density and porosity are eliminated. Thus, cassettes including the reinking apparatus of the present invention have a greater repeatability of print quality.

Yet another advantage of the present invention is that the reinking device of the present invention allows a higher density measurable print for a longer period of time over cassettes having reinking devices using foam or felt pads and capillary pressure for ink transfer.

Although the ball transfer mechanism is similar to known mechanisms used in rollerball markers or ball point ink pens, applicant does not believe a ball transfer mechanism has been provided in a reinking device as described in the above description of the invention to provide the advantages over and solve problems associated with known reinking devices.

Although the invention has been described with particular reference to certain preferred embodiments thereof, variations and modifications of the present invention can be effected within the spirit and scope of the following claims.

What is claimed is:

1. An apparatus for re-inking a printing ribbon, comprising:

a tank having an opening and containing liquid ink;

a ball rotatable positioned in the opening of the tank for receiving liquid ink from the tank, wherein the ball is formed of a porous material;

a wheel rotatable positioned adjacent and in frictional contact with the ball, the wheel for receiving liquid ink from the ball, and a roller for guiding the printing ribbon and for receiving liquid ink from the wheel and transferring the liquid ink to the printing ribbon.

2. The apparatus of claim 1 wherein the porous ball is a ceramic material.

3. The apparatus of claim 1 wherein the wheel includes a neoprene sheath.

4. The apparatus of claim 1 wherein the roller for guiding the printing ribbon is a gear.

5. An inked printer ribbon cassette, comprising:

a housing;

a printing ribbon; and an apparatus for re-inking the printing ribbon including a tank having an opening and containing liquid ink;

a ball rotatable positioned in the opening of the tank for receiving liquid ink from the tank, wherein the ball is formed of a porous material;

a wheel rotatably positioned adjacent and in frictional contact with the ball, the wheel for receiving liquid ink from the ball; and a roller for guiding the printing ribbon and for receiving liquid ink from the wheel and transferring the liquid ink to the printing ribbon.

6. The apparatus of claim 5 wherein the porous ball is a ceramic material.

7. The apparatus of claim 5 wherein the wheel includes a neoprene sheath.

8. The apparatus of claim 5 wherein the roller for guiding the printing ribbon is a gear.

* * * * *